US010154934B2

(12) United States Patent
Canty

(10) Patent No.: US 10,154,934 B2
(45) Date of Patent: Dec. 18, 2018

(54) INFECTIOUS DISEASE ISOLATION AND TREATMENT ENCLOSURE SYSTEM

(71) Applicant: J.M. Canty International LTD., Dublin (IE)

(72) Inventor: Thomas M. Canty, Amherst, NY (US)

(73) Assignee: JM CANTY INTERNATIONAL, LTD., Dublin (IE)

( * ) Notice: Subject to any disclaimer, the term of this patent is extended or adjusted under 35 U.S.C. 154(b) by 325 days.

(21) Appl. No.: 14/952,957

(22) Filed: Nov. 26, 2015

(65) Prior Publication Data

US 2016/0151218 A1 Jun. 2, 2016

Related U.S. Application Data

(60) Provisional application No. 62/085,349, filed on Nov. 28, 2014.

(51) Int. Cl.
*A61G 10/00* (2006.01)
*A61G 7/047* (2006.01)

(52) U.S. Cl.
CPC ..... *A61G 10/005* (2013.01); *A61G 7/047* (2013.01)

(58) Field of Classification Search
CPC .. A61G 10/005; A61G 7/047; A61G 13/1265; A61B 90/37
See application file for complete search history.

(56) References Cited

U.S. PATENT DOCUMENTS 3,265,059 A * 8/1966 Matthews ..... A61G 10/005 135/117
5,950,625 A * 9/1999 Bongiovanni ..... A61G 1/04 128/845

FOREIGN PATENT DOCUMENTS

GB 1329539 A 9/1973
WO WO 9929235 A1 6/1999
WO WO 2009037606 A1 3/2009

* cited by examiner

*Primary Examiner* — Christine H Matthews
*Assistant Examiner* — Joshua D Lannu
(74) *Attorney, Agent, or Firm* — Leydig, Voit & Mayer, Ltd.

(57) ABSTRACT

An isolation and treatment enclosure system for a patient includes a bed module that supports the patient, a spool disposed at a first end of the bed module, and a flexible, continuous enclosure disposed on the spool. The flexible, continuous enclosure can be extended from the spool along a length of the bed module so as to create a tube in which the patient and the bed module are enclosed.

20 Claims, 6 Drawing Sheets

INFECTIOUS DISEASE ISOLATION AND TREATMENT ENCLOSURE SYSTEM

CROSS-REFERENCE TO PRIOR APPLICATION

Priority is claimed to U.S. Provisional Patent Application No. 62/085,349, filed on Nov. 28, 2014, the entire disclosure of which is hereby incorporated by reference herein.

FIELD

The invention relates to a system for isolating and treating patients having infectious diseases.

BACKGROUND

Patients suffering from infectious diseases and viruses often need to be quarantined or isolated from others to prevent spreading the patient's ailment to others. While in isolation, however, the patients often require medical treatment from healthcare workers that need protection from exposure to the disease or virus. A system is needed that provides isolation of the patient but still enables healthcare workers safe access for treatment. In addition patients need to be transported from room to room in vehicles and in the air.

SUMMARY

An isolation and treatment enclosure system for a patient includes a bed module that supports the patient, a spool disposed at a first end of the bed module, and a flexible, continuous enclosure disposed on the spool. The flexible, continuous enclosure can be extended from the spool along a length of the bed module so as to create a tube in which the patient and the bed module are enclosed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
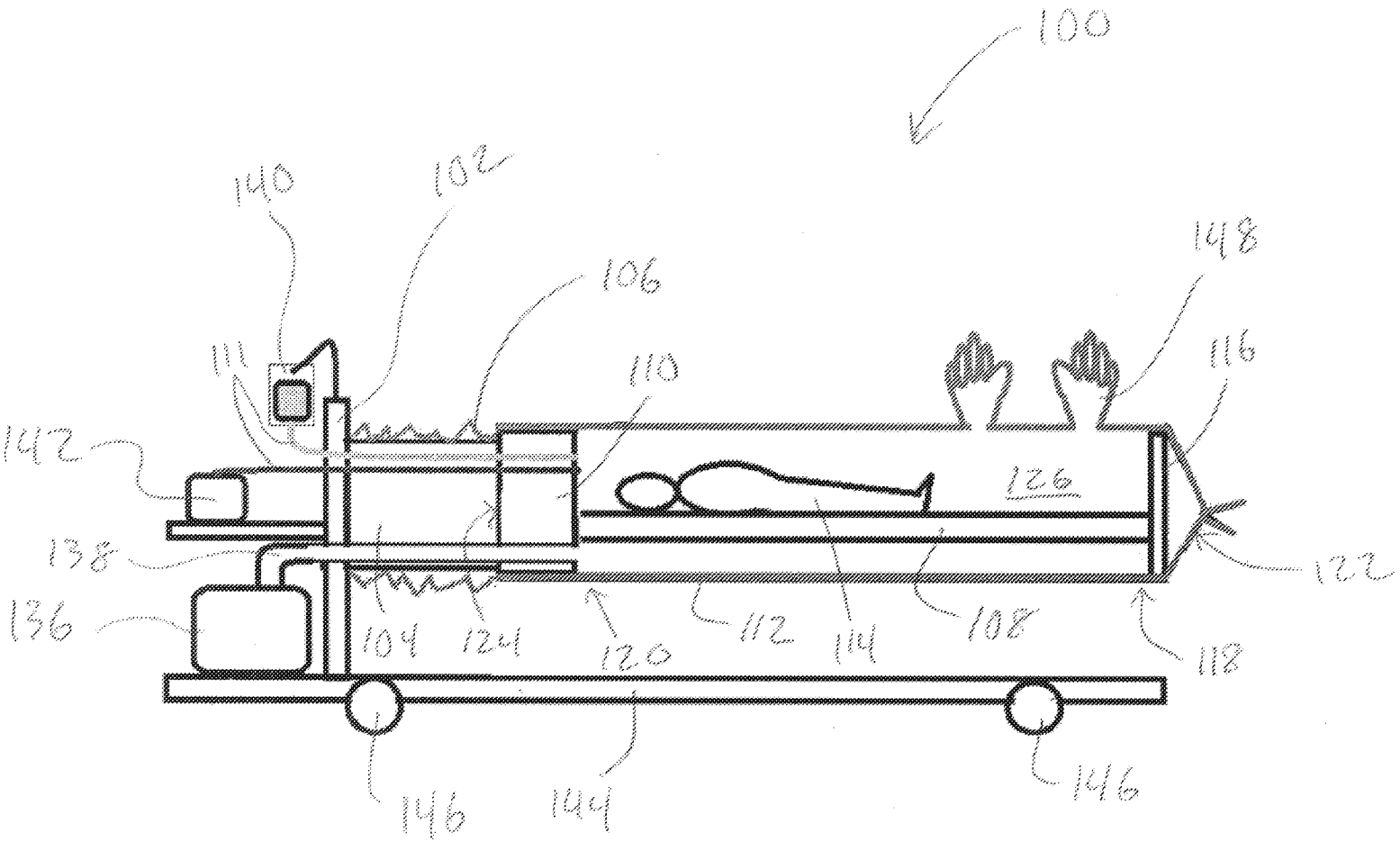
FIG. 1 shows side view of an enclosure system in accordance with an embodiment of the invention.

An aspect of the invention provides an enclosure system 100 for the treatment of a patient 114 and protection of medical care personnel where infectious diseases are diagnosed. In particular, as shown in FIG. 1, the enclosure system 100 compromises a mounting base 102 which contains a spool 104 for holding a flexible, plastic, continuous enclosure or tube 106. The flexible enclosures 106 are loaded onto and sealed to a collar (o-ring or thermal seal) that slides onto the spool and is o-ring sealed for containment. This allows for additional spool cartridges to slide onto the smaller spool that is the patient support and slide over the first spool allowing additional tubes to be added as needed. The mounting base 102 also provides a support structure for the patient bed module 108. The bed module 108 can be a cantilevered bed module that includes an instrument panel 110. The cantilevered bed also can act as distribution header for fresh air Oxygen treatment. Alternate accessories include a gel base which can be pressurized to move the patient's limbs to avoid bed sores, and can be heated or cooled for patient comfort. The instrument panel 110 can be disposed, for example, at the patient's head. Instrument power and fluids can be securely transported through the instrument panel 110 in a manner that provides no physical pathway outside the intended conduit channel 111. In some embodiments a ventilator 136 can provide oxygen, fresh air, or other fluids into the enclosure via a ventilation conduit 138. Exhaust gas can be filtered as needed. Filters are not limited to but may include any combination of Hepa Filters, thermally destructive gas filters (typical of the Buffalo Bio Blower), etc. Other instruments, such as an intravenous (IV) fluid drip system 140 or vital sign instruments 142, can be mounted to the mounting base 102. It is contemplated that the enclosure system 100 and tube 112 (explained in further detail below) can sustain at least a slightly positive pressure or negative pressure as desired. In some embodiments, the mounting base 102 can include a wheel base 144 with a plurality of wheels 146 allowing transport of the enclosure system 100 as desired.

A continuous roll of flexible, transparent plastic tubing 112 which can be tubular or elliptical in cross section shape is configured to be pulled into position from the spool 104 in any length needed to dispose of waste, by-products, food, clothing, or to enhance patient comfort. This flexibility in drawing as much flexible plastic tubing as desired allows for efficiency and flexibility in application. It is contemplated, however, that other suitable materials other than plastic may be used to form the tubes as well. In addition, an optional acrylic cover or tube can be provided (such as used with a monoplace hyperbaric chamber) to enhance safety and avoid accidental tearing of the flexible containment tube. In addition, the optional cover can provide support structure to safely place the tube in positive pressure. The tubes 112 can be pulled from the spool 104 so as to fit completely around the instrument panel 110, encompass the patient 114 and the bed 108, and fit around a hoop 116 on a distal end 118 of the bed. The tube 112 can be sealed at an instrument end 120 and a hoop end 122 to provide a complete barrier preventing medical personnel from exposure to the disease organisms. In some embodiments, the tube 112 can be molded with glove attachments 148 for patient access by medical personnel. Additionally, in some embodiments, ports for evacuation of waste fluids can be provided on the tube. The tube 112 can be made longer than the bed module 108 in order to provide for evacuation of solid wastes in sections that are sealed and removed from the end of the tube.

In some embodiments, the spool mount 104 is hollow and connects to the bed module 108 so as to allow for fluid, power, and breathing gas ventilation connections to come through the center of the spool mount. The spool mount 104 can attach to the external side 124 of the instrument panel 110 to allow fluid, instrument power, electricity, and breathing gas ventilation ingress to the sealed tube interior 126 where the patient 114 is located. The spool mount 104 provides for the pre-loading of unused tubes 106 prior to pulling the tubes over the patient bed 108.

Figure 2:
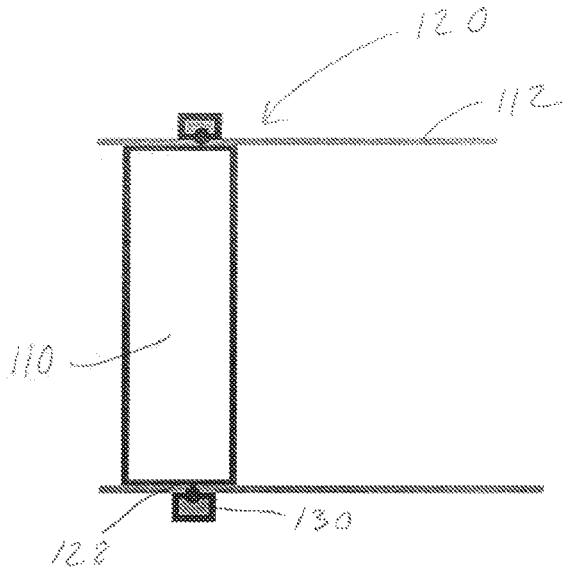
FIG. 2 shows an enlarged side view of a sealing arrangement for a tube of the enclosure system of FIG. 1.

Referring now to FIG. 2, the tube 112 can fit snugly over the instrument panel 110. The instrument end 120 of the tube 112 can be sealed between an interior o-ring 128 mounted on the instrument panel 110 and an external ring 130. The external ring 130 can fit snugly over the plastic tube 112, sealing it to the interior o-ring 128. In some embodiments, it is contemplated that either the interior o-ring or the external ring could be inflatable rings. In some embodiments, other types of suitable seals or sealing rings can be used to seal the instrument end 120 of the tube 112.

Figure 3:
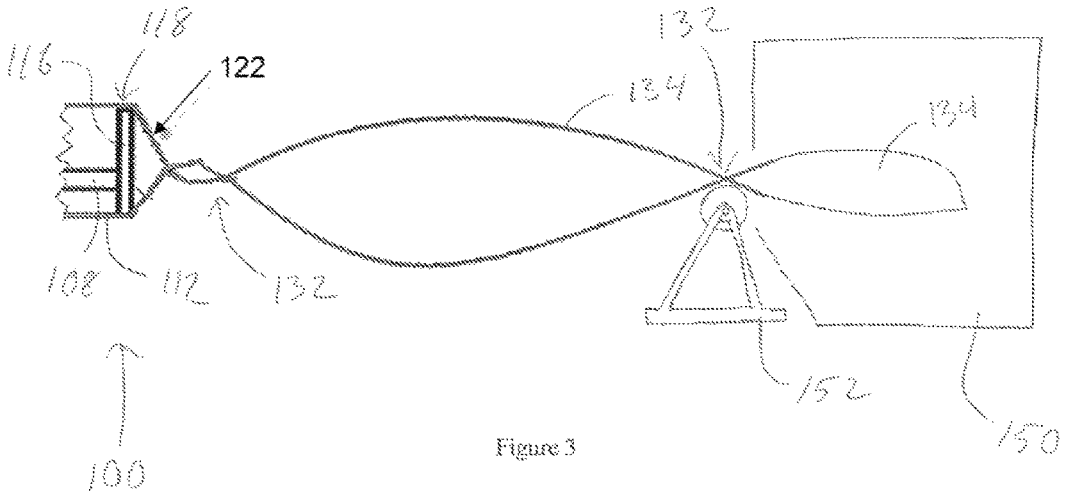
FIG. 3 shows disposal bags and a disposal container of the enclosure system of FIG. 1, the disposal bags shown sealed after use.

Referring now to FIG. 3, the opposite, hoop end 122 of the tube 112 can be sealed in an air and liquid tight hoop end seal 132 manner so as to prevent internal fluids, vapor, air, and other materials from escaping without proper disposal or treatment. The hoop end 122 of the tube 112 can be thermally or mechanically sealed, or sealed in another suitable manner so as to provide an air and fluid tight seal. As shown in FIG. 3, once a new tube 112 is pulled over the hoop 116 and the hoop end seal 132 is made, a fully sealed disposal bag 134 is formed that contains any waste or other patient material. The sealed disposal bag 134 can then be separated from the new tube 112 in any suitable manner while maintaining seals 132 at both ends so that the patient waste or other material can be disposed of properly. In this way, the enclosure system 100 provides a method for removing contaminated materials from the patient without exposing any medical workers or other personnel to potentially dangerous materials.

As shown in FIG. 3, embodiments of the enclosure system 100 may also include a disposal container 150 for receiving sealed disposal bags 134 once they are sealed and ready to be discarded. To aid in disposal, the enclosure system 100 can include a roller 152 over which the disposal bags 134 can be rolled to propel the bags into the disposal container. It is contemplated that, in some embodiments, the roller 152 can be any suitable type of conveyor system for transporting disposal bags into the disposal container 150, such as a belt or set of rollers. It is also contemplated that the disposal container 150 can be approved for safe transport to a disposal site, such as by the United States Department of Transportation or other regulatory entity.

The disclosed enclosure system 100 can allow for the isolation and treatment of a patient with an infectious disease or other ailment. Periodically during treatment or once treatment is complete, the tube 112 establishing the isolation chamber can be removed and sealed for disposal without any other medical personnel being exposed to the contents of the bag and, simultaneously, providing a new, clean enclosure for the patient to continue treatment. If a patient has completed treatment and isolation is no longer desired, the bag can be removed and disposed without providing a new enclosure. Used disposal bags 134 can be safely stored or disposed of in a disposal container 150 for further transportation or destruction. At this time, the bed 108 and other instruments can be sterilized and prepared for continued use by another patient. It is contemplated that the disclosed enclosure system 100 can be used as a stationary system or in motion, such as in a ground vehicle or during air travel.

In an embodiment of a method of isolating and treating a patient 114, a disposable, continuous enclosure or tube 106 is loaded onto the loading spool 104. Several tubes 106 can be loaded for each patient. The patient 114 can then be placed onto the cantilevered bed 108 and the first tube 112 can be drawn out over him/her and sealed or crimped at the hoop end 122. Glove adapters 148 can be included as part of the tube 112 (or they can be cut into the tube) for administering care while patient 114 is in the tube. An instrument panel 110 can be disposed at an instrument end 120 of the bed 108, where IVs, instrument probes etc., can be hooked up. Any desired probes for administration of tests, monitoring, or other treatment can be stored inside the enclosure, for instance, in a storage cabinet under the bed 108. Oxygen or other fluids for ventilating the patient 114 can be provided through the instrument panel 110 via a blower or ventilator 136 designed for biological systems. It is contemplated that exhaust air can be released, captured, and treated (scrubbed). If a new tube 106 is desired, such as because waste or other materials require removal, the current tube 112 can be pulled over the hoop 116. Waste materials can then be placed into the tube beyond the crimping point. Both the new tube 112 (to one side of the crimping point) and the used, disposal bag 134 (to the other side of the crimping point) are crimped and separated. The disposal bag 134 is disposed of with all its contents in a proper manner. In some embodiments, the disposal bag 134 is transferred into the disposal container 150 with or without a roller 152. The disposal container 150 can then safely store used disposal bags 134 until such time as the disposal container can be transported away for emptying or destruction of the contents.

Figure 4:
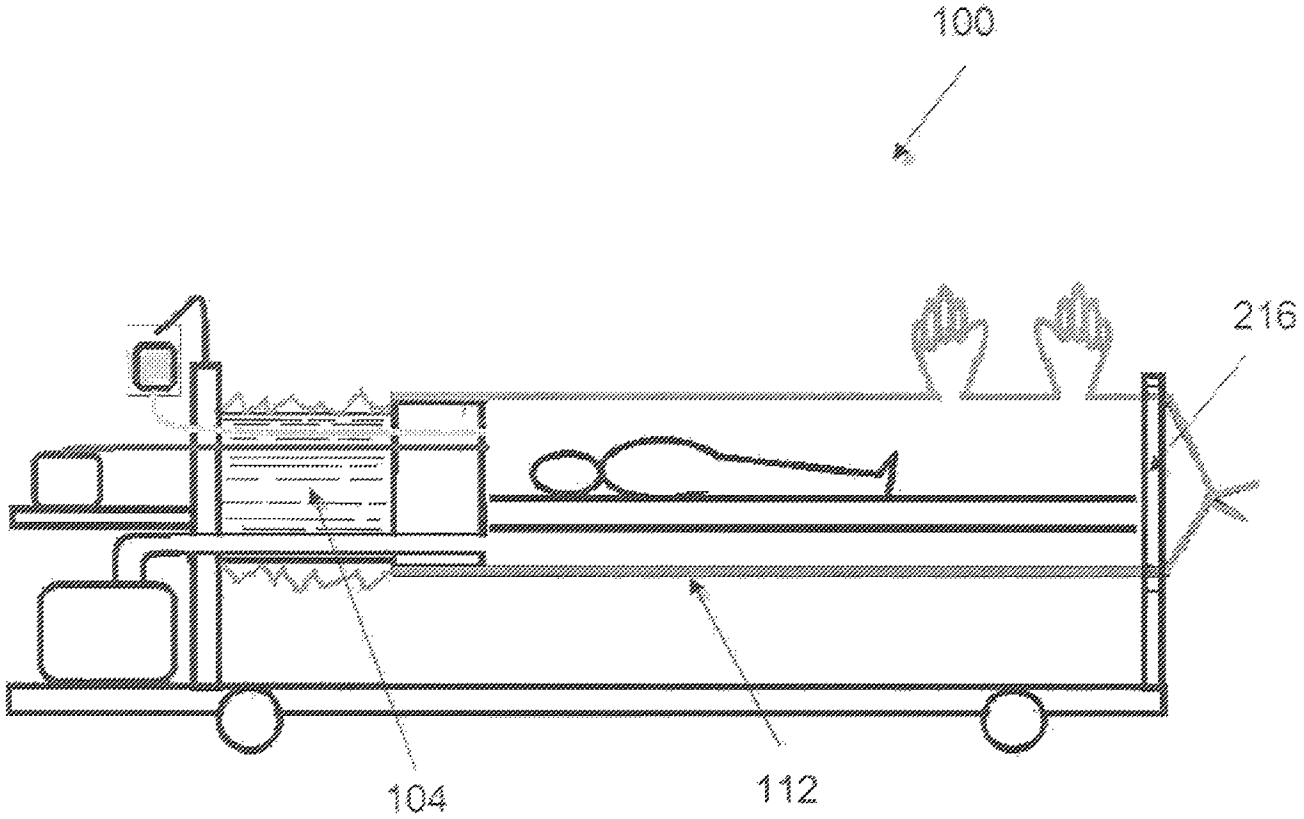
FIG. 4 shows an embodiment of the enclosure system that includes an exterior hoop system.

FIG. 4 shows an embodiment of the enclosure system 100 configured with an exterior hoop 216. In such an embodiment, the tube 112 can be pulled from the spool 104 and through the exterior hoop 216, instead of over the hoop as in other embodiments. This embodiment prevents the hoop 216 from being exposed to fluids and other waste products distributed inside the tube 112, which reduces the need for sterilizing the hoop between patients and uses.

Figure 5:
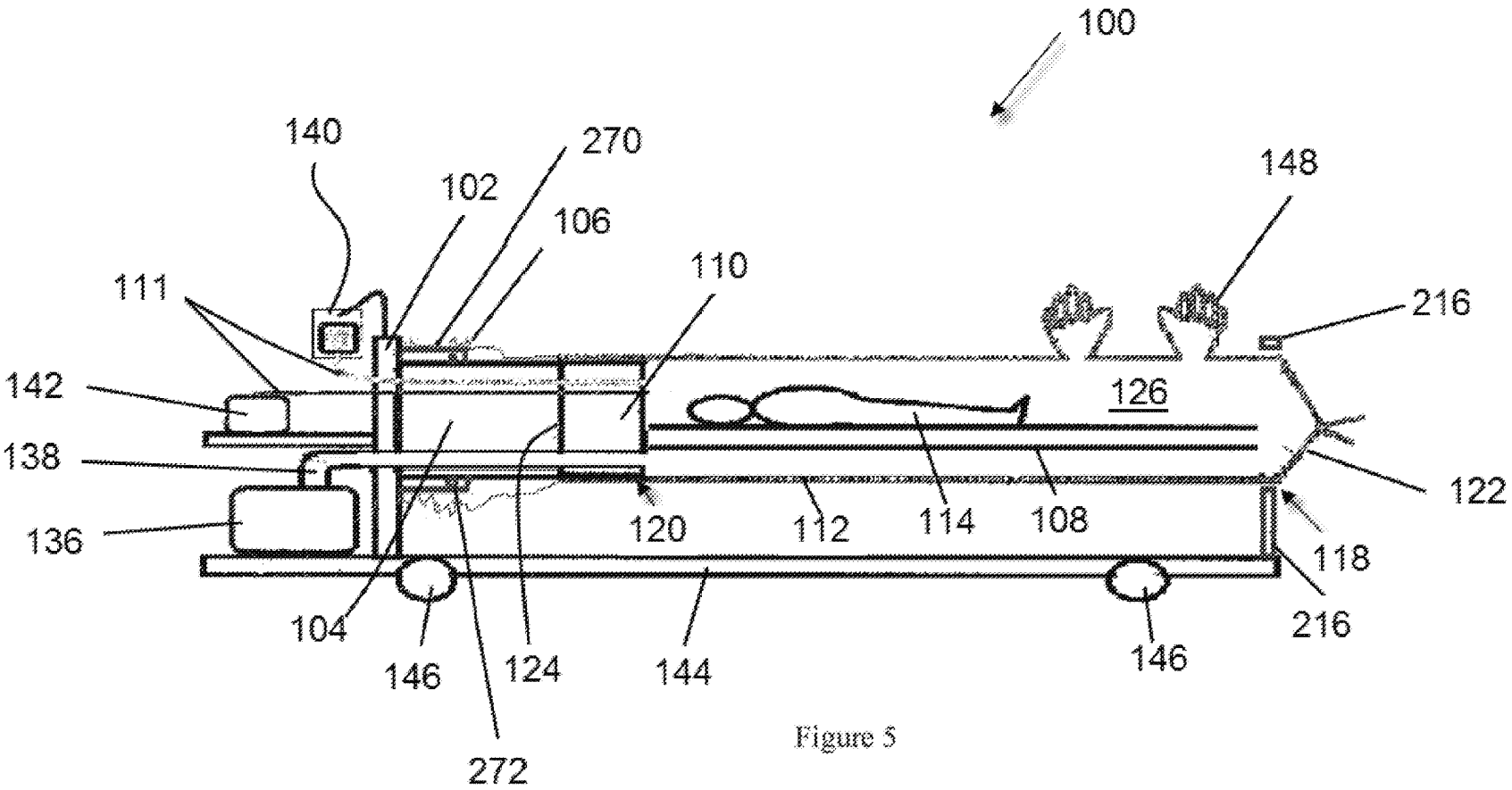
FIG. 5 shows and embodiment of the enclosure system that includes a spool with a sliding collar.

FIG. 5 shows another embodiment of the enclosure system 100 that is configured with an exterior hoop 216 as well as a spool 104 that includes a sliding collar 270 over the spool. In such embodiments, the sliding collar 270 includes an inner seal 272, such as an o-ring, that surrounds the spool 104 to create a sealed, sterile environment but still allows the collar to slide on and off of the spool. Unused tubes 106 can be stored within the collar 270 from where they can be pulled to span over the bed 108 and connect to the hoop 116, 216. In some embodiments, one of the unused tubes 106 can be thermally or otherwise sealed to the collar 270 in order to establish a complete seal.

Figure 6:
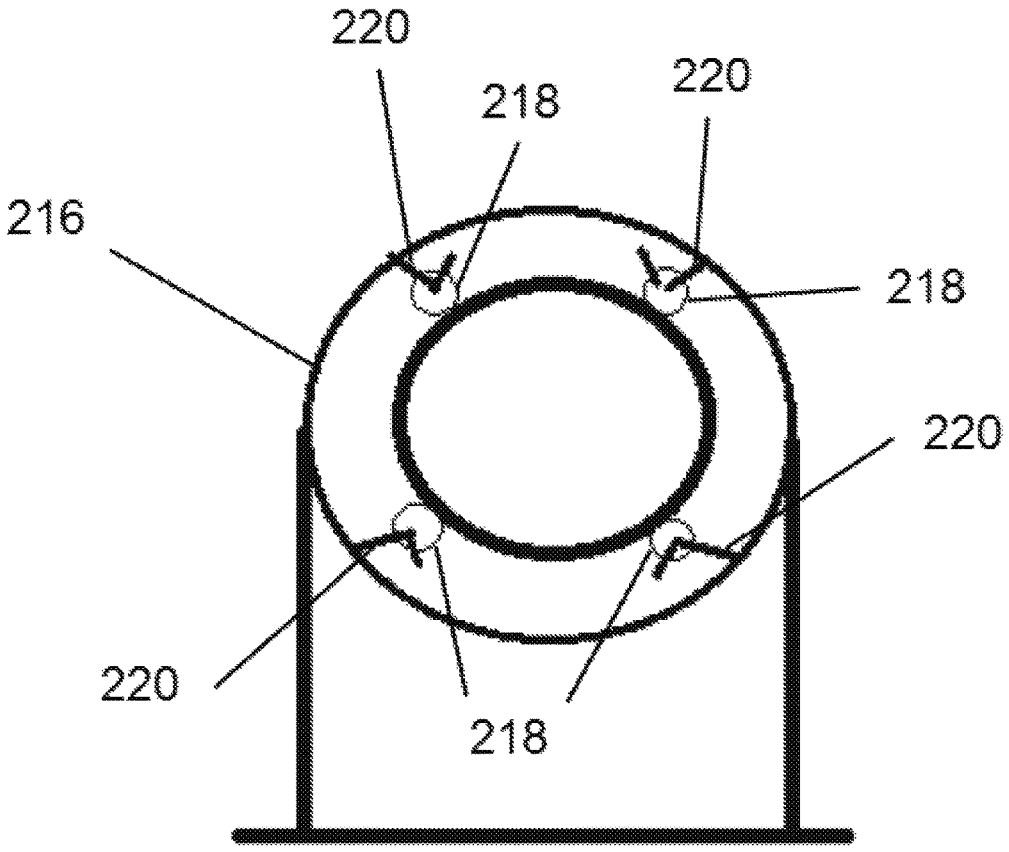
FIG. 6 shows a front view of the exterior hoop system of FIG. 4.

FIG. 6 shows an embodiment of the exterior hoop 216 of FIG. 4. In embodiments that include the exterior hoop 216, the tubes 112 can include connection rings 218 on the exterior of the tubes in order to connect to connecting hooks 220 of the hoop 216. Although rings and hooks are shown in FIG. 6, other types of connections between the exterior hoop 216 and the tubes 112 are contemplated herein. The exterior hoop 216 and connecting hooks 220 can help in holding the generally cylindrical shape of the tube 112 and allow for sealing on the distal end.

Figure 7:
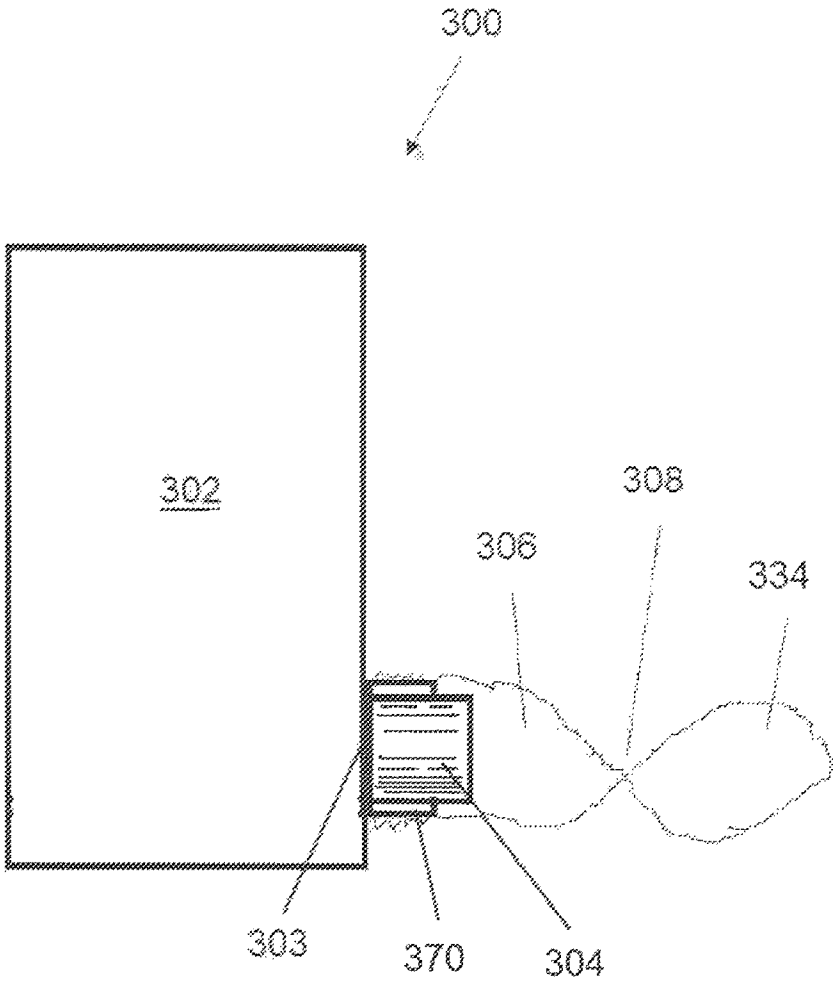
FIG. 7 shows an embodiment of a bag sealing and disposal system connected to a quarantined area.
Figure 7:
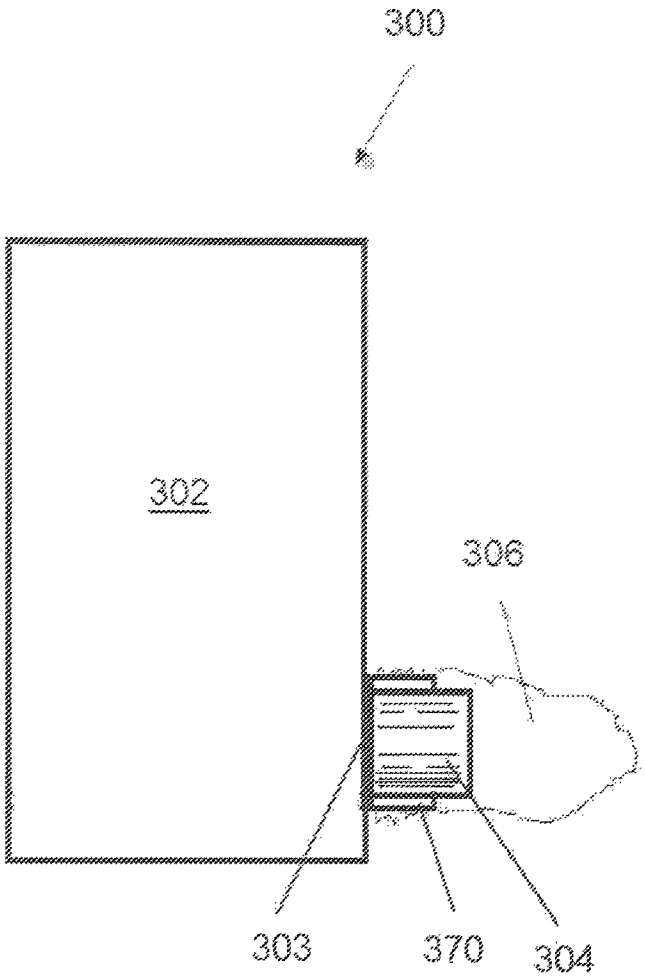

FIG. 7 shows an embodiment of a disposal system 300 for disposing of waste materials from quarantined areas 302. In such embodiments, the quarantined area 302 can be a structure containing any type of material that is desired to be quarantined, or a structure within which potentially dangerous or toxic materials are being produced and require disposal. Waste can be disposed through a disposal orifice 303 in the wall or exterior of the quarantined area 302. The disposal orifice 303 can be surrounded by a tubular spool 304, and at least one unused bag or tube 306 can be disposed around the spool. A bag 306 can be pulled from the spool 304 and crimped in order to create a seal 308, either thermally or in another suitable sealing manner. Once waste is disposed in the bag 306, another bag can be pulled from the spool 304, and the open end of the bag can also be sealed to create a fully sealed disposal bag 334 containing waste, as shown in FIG. 7. The disposal bag 334 can then be cut from the new bag 306 around the seal 308, allowing the disposal bag to be removed and disposed of. A fresh bag 306 is then available to receive waste without exposing any of the toxic material from the quarantined area to the surrounding area. It is contemplated that, in some embodiments, at least one of the unused bags 306 can be sealed to the spool 304. In other embodiments, a sliding collar 370, such as that described in reference to FIG. 5, can be used to hold unused bags 306.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An isolation and treatment enclosure system for a patient, the system comprising:

a bed module configured to support the patient;

a tubular mount disposed at a first end of the bed module; and a flexible, continuous tubular enclosure disposed on the tubular mount, wherein the enclosure is configured to be extended from the tubular mount along a length of the bed module and surrounding the bed module so as to create a tube in which the patient and the bed module are enclosed.

2. The system of claim 1, wherein the tube further comprises a first seal disposed at the first end of the bed module and a second seal disposed at a second end of the bed module that is opposite the first end.

3. The system of claim 2, wherein at least one of the first seal or the second seal comprises an air- and fluid-tight seal.

4. The system of claim 1, further comprising a hoop disposed at a second end of the bed module that is opposite the first end, the hoop being configured to support the tube.

5. The system of claim 4, further comprising a hoop end seal adjacent the hoop, the hoop end seal comprising an air- and fluid-tight seal.

6. The system of claim 4, wherein the hoop is configured such that the tube can be extended around a periphery of the hoop so as to form a hoop end seal.

7. The system of claim 4, wherein the hoop is configured such that the tube can be extended through the hoop so as to form a hoop end seal.

8. The system of claim 1 further comprising an instrument panel disposed at the first end of the bed module, the instrument panel including a conduit channel that provides a physical pathway into the tube.

9. The system of claim 8 further comprising:

an interior o-ring disposed on the instrument panel; and an external ring disposed around the flexible, continuous enclosure so as to seal the flexible, continuous enclosure to the interior o-ring.

10. The system of claim 1, further comprising a ventilator configured to provide at least one of oxygen or fresh air into the tube via a ventilation conduit.

11. The system of claim 1 further comprising a disposal container configured to receive the tube after it has been used to enclose the patient and the bed module.

12. The system of claim 11 further comprising a conveyor system configured to propel the tube into the disposal container.

13. The system of claim 12, wherein the conveyor system comprises at least one of a roller, a plurality of rollers, or a belt.

14. The system of claim 1, wherein the flexible, continuous enclosure includes glove adapters.

15. The system of claim 1 further comprising a cover configured to provide a support structure for the tube to place the tube in positive pressure.

16. The system of claim 1 further comprising one or more ports configured to evacuate waste from the tube.

17. The system of claim 1 wherein the tubular mount further comprises a sliding collar disposed on the tubular mount, the sliding collar including an inner seal so as to seal the flexible, continuous enclosure to the tubular mount.

18. A method for providing an isolated treatment enclosure for a patient on a bed module, the method comprising:

loading a flexible, continuous enclosure on to a tubular mount disposed at a first end of a bed module;

extending the flexible, continuous enclosure over a length of the bed module so as to enclose the patient and the bed module therein in a first tube; and sealing the first tube at a second end of the bed module that is opposite the first end of the bed module.

19. The method of claim 18 further comprising:

extending the first tube past the second end of the bed module and extending the flexible, continuous enclosure over the length of the bed module so as to enclose the patient and the bed module therein in a second tube; and separating the first tube from the second tube.

20. The method of claim 19 further comprising:

transferring the second tube to a disposal container.

* * * * *